US008986463B2

(12) United States Patent
Egger et al.

(10) Patent No.: US 8,986,463 B2
(45) Date of Patent: Mar. 24, 2015

(54) DISHWASHER OPERATING PANEL SEAL

(75) Inventors: Gerhard Egger, Altenmünster (DE); Norbert Gerstner, Herbrechtingen (DE); Bernd Schessl, Dillingen (DE); Rainer Schilling, Bachhagel (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 918 days.

(21) Appl. No.: 13/132,323

(22) PCT Filed: Dec. 2, 2009

(86) PCT No.: PCT/EP2009/066180
§ 371 (c)(1),
(2), (4) Date: Jun. 2, 2011

(87) PCT Pub. No.: WO2010/069760
PCT Pub. Date: Jun. 24, 2010

(65) Prior Publication Data

US 2011/0232194 A1 Sep. 29, 2011

(30) Foreign Application Priority Data

Dec. 19, 2008 (DE) ..... 10 2008 055 027

(51) Int. Cl.
*A47L 15/42* (2006.01)

(52) U.S. Cl.
CPC ..... *A47L 15/4293* (2013.01); *A47L 15/4257* (2013.01)
USPC ..... 134/56 D

(58) Field of Classification Search
CPC ..... A47L 15/421; A47L 15/4263; A47L 15/4293; A47L 15/4257
USPC ..... 134/56 D
See application file for complete search history.

(56) References Cited

U.S. PATENT DOCUMENTS

| | | | | |
|---|---|---|---|---|
| 2003/0041523 | A1 | 3/2003 | Kiesler et al. | |
| 2003/0230955 | A1* | 12/2003 | Welch | 312/228 |
| 2006/0114128 | A1 | 6/2006 | Prinz et al. | |
| 2007/0292637 | A1 | 12/2007 | Roy-Martinache | |
| 2008/0134728 | A1 | 6/2008 | Son | |

(Continued)

FOREIGN PATENT DOCUMENTS

| | | | |
|---|---|---|---|
| CN | 2366038 | Y | 3/2000 |
| DE | 10017073 | A1 | 10/2001 |
| DE | 10200317 | A1 | 7/2003 |

(Continued)

OTHER PUBLICATIONS

International Search Report PCT/EP2009/066180.

(Continued)

*Primary Examiner* — Michael Barr
*Assistant Examiner* — Spencer Bell
(74) *Attorney, Agent, or Firm* — James E. Howard; Andre Pallapies

(57) ABSTRACT

A dishwasher, in particular a domestic dishwasher, includes a domestic-appliance door which has at least one front operating panel and an internal door element. A seal is arranged at least in one area between the operating panel and the internal door element and includes a sealing element and a sealing bed, with the sealing element and the sealing bed forming a one-piece structural unit.

25 Claims, 5 Drawing Sheets

(56) References Cited

U.S. PATENT DOCUMENTS

2009/0288692 A1* 11/2009 Haeberle et al. ..... 134/58 D
2009/0320886 A1* 12/2009 Poyner et al. ..... 134/115 R

FOREIGN PATENT DOCUMENTS

EP 1281345 A1 2/2003
EP 1358837 A2 11/2003
GB 2130082 A 5/1984

OTHER PUBLICATIONS

National Search Report DE 10 2008 055 027.2.
National Search Report CN 200980150906.9 dated Dec. 7, 2012.
Granting Decision RU 2011126659 dated Sep. 18, 2014.

* cited by examiner

DISHWASHER OPERATING PANEL SEAL

BACKGROUND OF THE INVENTION

The invention relates to a dishwasher.

With regard to dishwashers, the operating panel with its control and display elements can be provided in the appliance door. The operating panel implemented as a plastic part can extend over the entire door width at the upper edge of the appliance door.

Such a generic domestic appliance door has an internal door element, facing towards a usable space, on which the operating panel is mounted. The operating panel is in contact with the internal door element by means of an angled panel casing.

In particular when the domestic appliance door is open, lying approximately in a horizontal plane, the liquid dripping off crockery baskets which have been pulled out can penetrate into the interior of the door by way of gaps between the operating panel and the internal door. In order to protect against penetrating liquid, the electronic components associated with the operating panel can be encapsulated in complex housings or the penetrating liquid can be diverted by means of additional parts such as shielding foils or the like. This proves to be very complex for example on account of existing contacts on the wiring harness and the required cutouts in the housing.

BRIEF SUMMARY OF THE INVENTION

The object of the invention consists in making available a dishwasher in which the appliance components assigned to the operating panel are protected in a simple manner against penetrating liquid.

The object is achieved by the features of the invention. Preferred developments of the invention are disclosed in the subclaims.

The invention is based on a dishwasher, in particular a domestic dishwasher, at least having a domestic appliance door, which has at least one operating panel and an internal door element, between which a seal formed at least from a sealing element and a sealing bed is arranged at least in certain sections.

According to the invention, the sealing element and the sealing bed form a one-piece structural unit, in particular a two-component extrusion. This simplifies assembly because only one structural part needs to be assembled, whereby the two-component extrusion can be manufactured simply as material sold by the meter and has an inherent rigidity which is convenient for the assembly process.

In a development, there is provision for the operating panel to be manufactured using a plastic injection molding process, and in particular a mold release direction (E) runs perpendicular to an operating panel front wall. The geometry of the operating panel is to be designed such that a mold release movement of the injection molding tooling is made possible without obstructions or without the provision of additional ejectors.

With regard to the manufacture of the operating panel as a plastic injection molded part, the dividing wall can be molded onto the sheet roof of the operating panel. A cutout can be provided between the dividing wall and the sheet roof, through which the sealing element can have its end taken into the liquid discharge chamber.

As mentioned above, the operating panel can be manufactured using a plastic injection molding process, wherein an injection molding chamber for shaping the operating panel is delimited by injection molding tooling.

For a simple sealing structure, according to the invention the sealing bed can be inserted as a separate structural part into the operating panel. In this way there is a greater flexibility in the geometrical configuration of the operating panel without there being a need to take into consideration undercuts because of the sealing bed.

The sealing bed can preferably be supported on at least one support element of the operating panel, free of undercuts in the mold release direction. By preference, the sealing bed can be supported on support ribs, spaced apart from one another, which are injection molded on the operating panel in the mold release direction. As a result of the rigidity of the sealing bed, relatively large spacings between the support ribs can be chosen.

To provide stable mounting for the sealing bed, the support element can have cutouts which can be used to effect preliminary positioning of the sealing bed approximately at right angles to the mold release direction in a fixed location on the operating panel. After preliminary positioning has taken place, the internal door element can be screwed to the operating panel, by which means the sealing element can be brought into sealing contact with the internal door element.

In a development, each side wall of the operating panel is assigned a liquid discharge chamber, through which the liquid penetrating at the side walls of the operating panel can be discharged. The operating panel according to the invention therefore has laterally configured water discharge regions, with the aid of which the liquid penetrating at the side walls can also be kept away from live components of the operating panel without additional sealing means. The side walls of the operating panel can thus be brought into contact with the internal door element free of sealing means, as a result of which the sealing requirement in the region between the operating panel and the internal door element is reduced.

With regard to dishwashers, the appliance door is usually hinge mounted around a horizontal pivot axis at the base of the machine pedestal. When loading items to be washed or when removing washed items, the crockery baskets are usually borne by the appliance door arranged in the horizontal plane. Liquid dripping from the crockery baskets or from the washed items may therefore, as described above, penetrate into the interior of the door. In order to ensure that water drains from the liquid discharge chamber of the operating panel, the liquid discharge chamber can be configured as open in the direction of the door pivot axis in respect of flow design.

When the appliance door is closed, the liquid collected in the liquid discharge chamber can therefore drain from the operating panel in the direction of the pivot axis.

The appliance components provided on the rear side of the operating panel can be spaced away from the operating panel side wall with the liquid discharge chamber interposed for protection against penetrating liquid, which means that the operating panel is implemented to be fluid tight in the region of the appliance components. The liquid discharge chamber can be separated in fluid tight fashion by way of a dividing wall from the appliance components of the operating panel.

The operating panel can usually extend over the entire door width at the upper door edge opposite the door hinge-mount side. In this situation, the operating panel can be manufactured as an approximately hood-shaped plastic part which has a front wall facing the user side, carrying the control and display elements. At the upper edge of the operating panel front wall, one side wall can be formed as a backward angled sheet roof, while similarly backward angled side walls can be formed at the side edges of the front wall. Each of the side walls of the operating panel can in each case be associated with one of the aforementioned dividing walls, such that the side wall together with the dividing wall produces a rigid double-wall structure with interposed liquid discharge chamber. In order to increase a torsional rigidity of the operating panel, the side wall and the dividing wall can be connected with one another by way of transverse walls which run at a distance from the rear side of the operating panel front wall.

In a preferred sealing arrangement, a strip-shaped sealing element which makes a fluid tight seal between the panel roof and the internal door element can run along the panel roof of the operating panel in the transverse direction of the door.

The operating panel is sealed over the entire door width by means of the aforementioned strip-shaped sealing element, while the corner regions are delimited by the liquid discharge chamber at the transition between the side walls and the panel roof. In this way, it is possible from an assembly viewpoint to advantageously avoid the need to take the sealing element around the corner region from the panel roof and the side walls. Rather, the aforementioned sealing element merely needs to be inserted in the transverse direction into the operating panel.

By preference, the transverse sealing element can project with each of its seal ends into the lateral liquid discharge chambers. In this way, liquid present on the sealing element can drip laterally into the liquid discharge chambers. In this situation, the strip-shaped sealing element can be spaced with its respective seal ends by way of a free space from the corner region between the panel side wall and the panel roof.

The aforementioned dividing wall for separating the liquid discharge chamber from the appliance components of the operating panel can preferably join the panel roof without any gap. During manufacture of the operating panel as a plastic injection molded part, the dividing wall can be molded onto the sheet roof of the operating panel. A cutout can be provided between the dividing wall and sheet roof, through which cutout the sealing element can be taken with its end into the liquid discharge chamber.

As mentioned above, the operating panel can be manufactured using a plastic injection molding process, wherein an injection molding chamber for shaping the operating panel is delimited by injection molding tooling. The geometry of the operating panel is to be designed such that a mold release movement of the injection molding tooling is made possible without obstructions or without the provision of additional ejectors. Against this background, a sealing bed for the sealing element can be molded on only with considerable effort in the connection region of the operating panel on the internal door element.

An exemplary embodiment of the invention is shown in the following with reference to the attached figures.

DETAILED DESCRIPTION OF EXEMPLARY EMBODIMENTS OF THE PRESENT INVENTION

Figure 1:
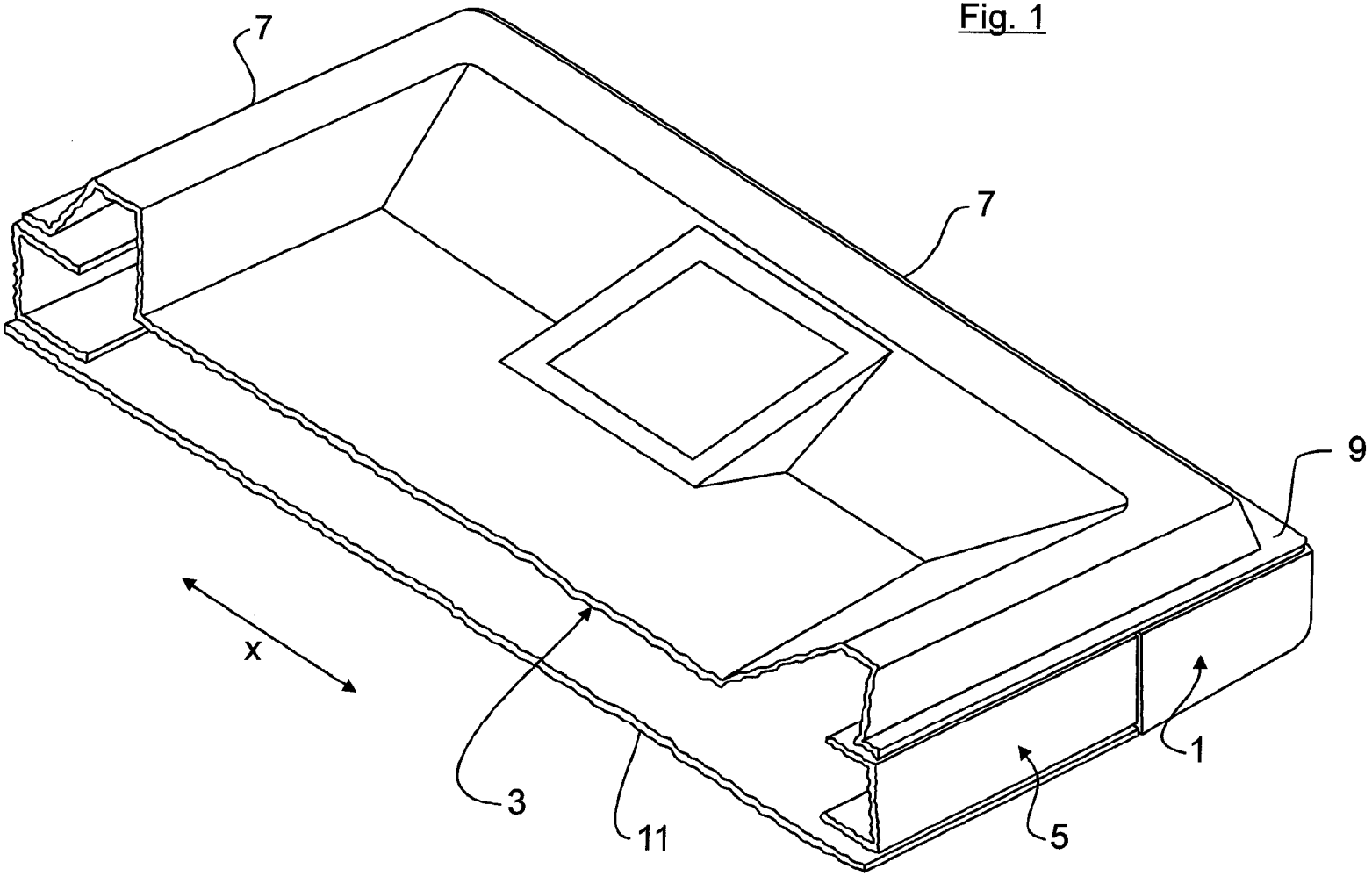
FIG. 1 shows a partial perspective view of an appliance door of a dishwasher.

FIG. 1 shows an appliance door of a dishwasher (not shown). The appliance door is hinge mounted in the horizontal direction in the usual manner at the base of the machine pedestal of the dishwasher. On the side of the door opposite the hinge-mount side an operating panel 1 is provided which extends as a plastic part over the entire door width. The operating panel 1 is affixed together with the internal door 3 on a door frame 5 which is only roughly hinted at in FIG. 1. According to FIGS. 1 and 2, the door frame 5 has lateral U-profile shaped frame strips facing one another.

When the appliance door is closed, the internal door 3 is facing the washing compartment of the dishwasher and is manufactured as a deep-drawn sheet-metal part. Accordingly, the internal door 3 has a frame-like circumferential door spar section 7 which projects into the washing compartment when the appliance door is closed. On the outside, the door spar section 7 becomes a circumferential mounting flange 9 which is screwed on the door frame strips. In the upper region of the appliance door, the mounting flange 9 of the internal door 3 is screwed to the operating panel 1. On the outside, opposite the internal door 3, in a known manner the door frame 5 carries exterior cladding or a furniture panel 11.

Figure 2:
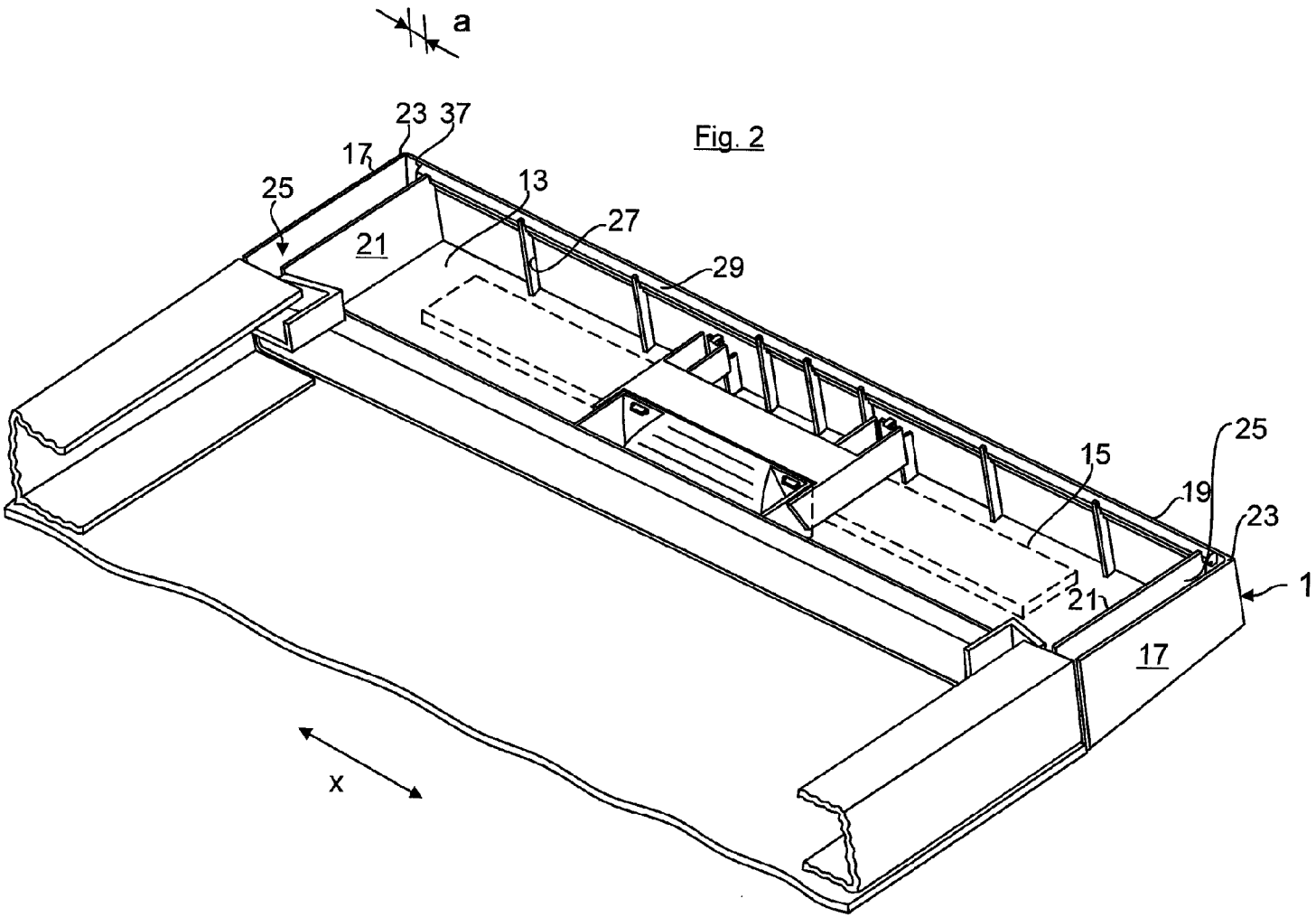
FIG. 2 shows the appliance door with the internal door element removed in a view corresponding to FIG. 1.

FIG. 2 shows the appliance door with the internal door 3 removed, so that the rear-side geometry of the operating panel 1 can be seen. The operating panel 1 accordingly has a front wall 13 facing the user, on the rear side of which is mounted a control module 15 (only indicated by dashed lines), using snap-in fastenings for example.

A panel casing 17, 19 angled in flange-like fashion is molded on the opposite side edges in the appliance side direction x and also on the upper edge of the front wall 13. The lateral panel casing sections 17 form side walls of the operating panel 1, while the upper panel casing 19 forms a panel roof. When the appliance door is assembled, the panel casing 17, 19 is brought into contact with the mounting flange 9 of the internal door 3. Screw bosses (not shown here), which are used to screw together the internal door 3, are formed on the inner side of the panel casing 17, 19.

According to Figure, 2 the side walls 17 situated opposite one another in the appliance side direction x are oriented approximately flush with the outside of the door frame 5. The two side walls 17 are connected to the panel roof 19 by way of corner regions 23.

Figure 3:
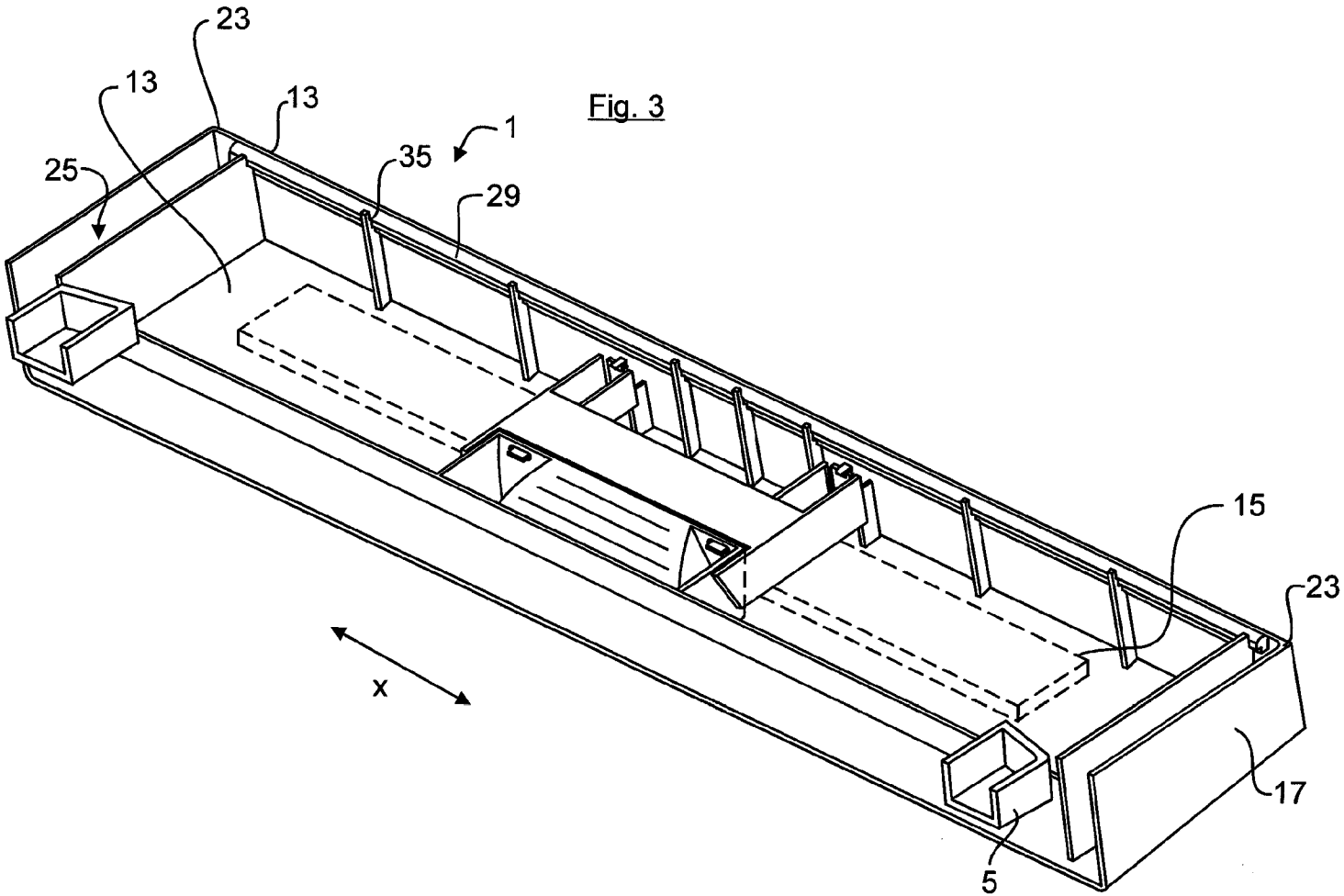
FIG. 3 shows a rear view of an operating panel in isolation.

According to FIGS. 2 and 3, each of the side walls 17 of the operating panel 3 is designed with a double wall with a dividing wall 21 spaced apart from it. Between the dividing wall 21 and the side wall 17 in each case is arranged a liquid discharge chamber 25 which is open in the direction of the door pivot axis. According to FIGS. 2 and 3, the dividing walls 21 are designed parallel to associated side walls 17 and are molded directly onto the panel roof 19. The control module 15 is provided in the region between the two dividing walls 21.

In the same manner as the dividing walls 21, support ribs 27 spaced apart from one another are molded onto the panel roof 19. The support ribs 27 carry a sealing element 29 implemented in a strip shape. In the installed position according to FIG. 4, the sealing element 29 seals a gap 31 between the mounting flange 9 of the internal door 3 and the panel roof 19.

Figure 4:
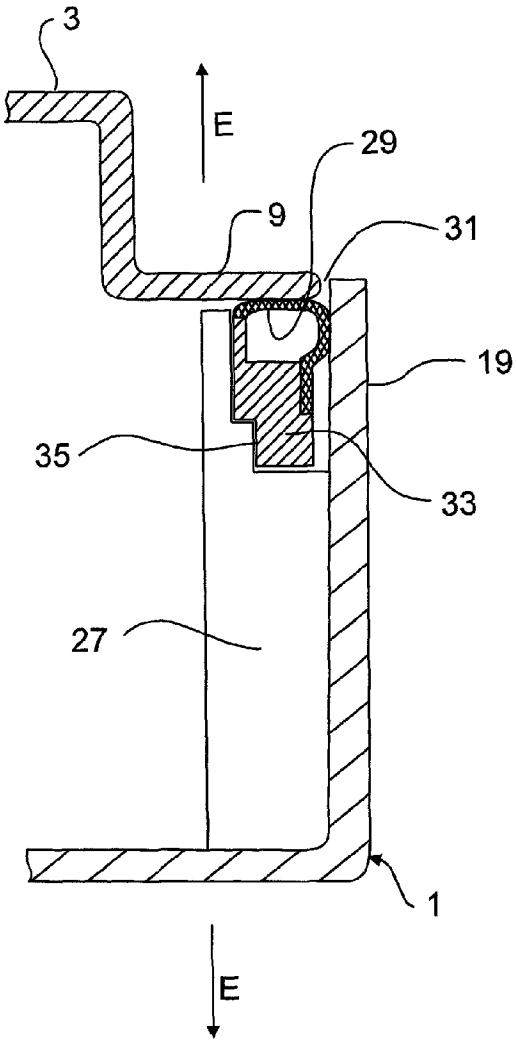
FIG. 4 shows an enlarged sectional view of a seal between the internal door element and the operating panel.
Figure 5:
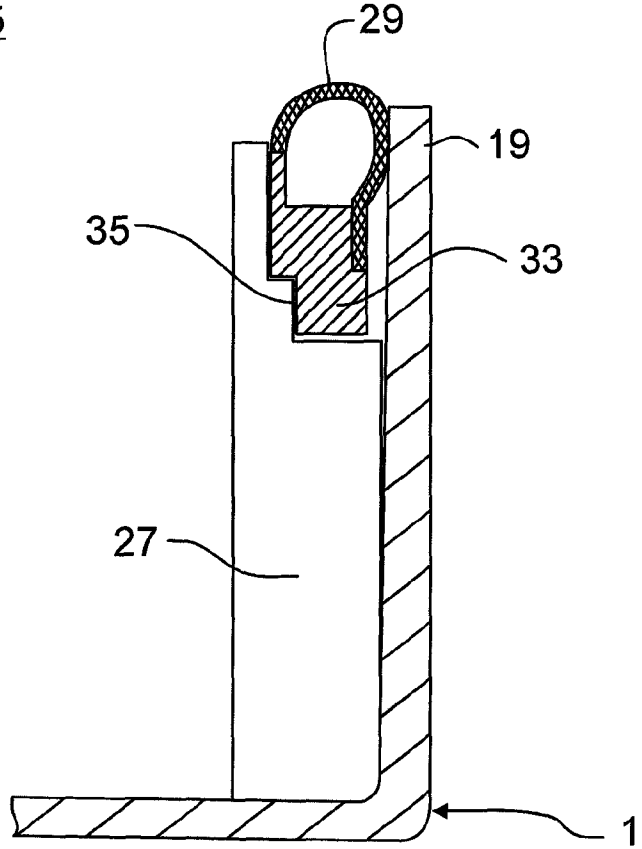
FIG. 5 shows a view corresponding to FIG. 4 of the operating panel with the internal door element removed.

As can further be seen from FIG. 4, the sealing element 29 has a cavity profile which is connected in a single piece in a two-component extrusion process to a strip-shaped sealing bed 33. Compared with the sealing element designed as a soft component, the sealing bed 33 is designed as a hard component.

As can be seen from the figures, between the support ribs 27 and the panel roof 19 and also between the dividing wall 21 and the panel roof 19 in each case are formed stepped cutouts 35, into which the sealing bed 33 is inserted to make a form fit, with the sealing element 29 arranged thereon.

During assembly of the appliance door, the sealing bed 33 is inserted together with the molded-on sealing element 29 in a pre-assembly step into the cutouts 35 of the dividing walls 21 and of the support ribs 27. Then the internal door 3 is screwed onto the operating panel 1 with the sealing element 29 pre-positioned therein.

According to FIGS. 2 and 3, the sealing element 29 projects with its ends 37 into the two liquid discharge chambers 25. In this situation, the sealing element 29 is spaced with its seal ends 37 by way of a space a from the respective corner regions 23 of the operating panel 1.

FIG. 4 shows the mold release direction E of the injection molding tooling after molding of the operating panel 1 has taken place. With the sealing bed 33 removed, the support ribs 27 are molded free of undercuts in the mold release direction E onto the panel roof 19, such that the mold release can take place free of undercuts and also without additional ejectors.

When loading the dishwasher with items to be washed or when removing washed items, the appliance door is situated in its horizontal open position. The lower crockery basket can be supported on the open appliance door in order to simplify the loading of items to be washed or removal of washed items. Liquid dripping off in this situation can reach the lateral liquid discharge chambers 25 by way of the unsealed gaps between the side walls 17 of the operating panel 1 and the mounting flange 9 of the internal door 3. In the region of the panel roof 19, on the other hand, the sealing element 29 is provided between the mounting flange 9 and the panel roof 19. The liquid collecting in the gap 31 can therefore be present on the sealing element 29 and drip off laterally at the ends 37 of the sealing element 29 into the liquid discharge chambers 25.

When the washing compartment is closed, the appliance door is pivoted back into its vertical closed position. This allows the liquid collected in the liquid discharge chambers 25 to discharge from the operating panel 1 in the direction of the door pivot axis.

LIST OF REFERENCE CHARACTERS

1 Operating panel
3 Internal door element
5 Door frame
7 Door spar section
9 Mounting flange
11 Exterior cladding
13 Operating panel front wall
15 Control module
17 Panel side walls
19 Panel roof
21 Dividing walls
23 Corner regions
25 Liquid discharge chambers
27 Support ribs
29 Sealing element
31 Gap
33 Sealing bed
35 Cutouts
E Mold release direction
a Space
x Door side direction

The invention claimed is:

1. A dishwasher, comprising:

a domestic appliance door which has at least one operating panel and an internal door element; and a seal arranged to provide a sealing action between the operating panel and the internal door element, the seal including a compressible sealing element and a rigid sealing bed, said sealing element and said sealing bed being fixed to one another and forming a one-piece structural unit that is separate from the operating panel and the internal door element, wherein the sealing element provides a fluid tight seal between a panel roof of The operating panel and the internal door element and runs along the panel roof in a transverse direction of the door.

2. The dishwasher of claim 1, wherein the dishwasher comprises a domestic dishwasher.

3. The dishwasher of claim 1, wherein the sealing element and the sealing bed form a two-component extrusion.

4. The dishwasher of claim 1, wherein the operating panel is manufactured using a plastic injection molding process.

5. The dishwasher of claim 1, wherein a mold release direction of an injection molding process runs perpendicular to an operating panel front wall.

6. The dishwasher of claim 5, further comprising at least one support element for support of the sealing bed free of undercuts in the mold release direction.

7. The dishwasher of claim 6, wherein the support element is realized by support ribs arranged in spaced-apart relationship.

8. The dishwasher of claim 6, wherein the support element has a cutout for securely holding the sealing bed in place at a right angle to the mold release direction.

9. The dishwasher of claim 1, wherein the operating panel has angled side walls in contact with the internal door element, and further comprising liquid discharge chambers, one associated with and for each of the side walls, for discharge of liquid penetrating at the side walls of the operating panel.

10. The dishwasher of claim 9, further comprising appliance components provided on a rear side of the operating panel spaced away from the operating panel side walls to provide protection against liquid penetrating via the liquid discharge chambers.

11. The dishwasher of claim 10, wherein each said liquid discharge chamber is separated by a dividing wall from the appliance components of the operating panel.

12. The dishwasher of claim 11, wherein the angled side walls are vertical, each of the side walls of the operating panel together with the dividing wall being configured as a double-wall structure with an interposed liquid discharge chamber.

13. The dishwasher of claim 11, wherein the dividing wall is connected with a panel roof of the operating panel in the absence of a gap.

14. The dishwasher of claim 9, wherein the sealing element has at least one seal end which projects into the liquid discharge chamber.

15. The dishwasher of claim 14, wherein the seal end of the sealing element is arranged at a free distance from a corner region between a panel side wall and a panel roof of the operating panel.

16. The dishwasher of claim 9, wherein the side walls of the operating panel are in non-sealing contact with the internal door element.

17. The dishwasher of claim 9, wherein angled side walls are vertical.

18. The dishwasher of claim 1, wherein the operating panel has a user-side front wall, and further comprising a panel roof angled rearwards on an upper edge of the front wall, said front wall having side edges on which side walls of the operating panel are formed and angled rearwards.

19. The dishwasher of claim 18, wherein the front wall extends over an entire width of the door.

20. The dishwasher of claim 1, wherein the sealing element is adapted to simultaneously contact the operating panel on a first surface and the internal door element on a second surface.

21. The dishwasher of claim 20, wherein the sealing bed is supported on a third surface.

22. A dishwasher, comprising:

a domestic appliance door which has at least one operating panel and an internal door element;

a seal arranged to provide a sealing action between the operating panel and the internal door element, the sealing including a sealing element and a sealing bed, said sealing element and said sealing bed forming a one-piece structural unit that is separate from the operating panel and the internal door element, wherein the operating panel has angled side walls in contact with the internal door element, and further comprising liquid discharge chambers, one associated with and for each of the side walls, for discharge of liquid penetrating at the side walls of the operating panel; and appliance component provided on a rear side of the operating panel spaced away from the operating panel side walls to provide protection against liquid penetrating via the liquid discharge chambers, wherein each said liquid discharge chamber is separated by a dividing wall from the appliance components of the operating panel and the dividing wall has a cutout, through which the sealing element is guided into the liquid discharge chamber.

23. The dishwasher of claim 22, wherein angled side walls are vertical.

24. A dishwasher, comprising:

a compartment adapted to wash dishes, the compartment having an opening;

a domestic appliance door adapted to close the opening and which has at least one operating panel and an internal door element;

a seal arranged at least in one area between the operating panel and the internal door element and including a sealing element and a sealing bed, said sealing element and said sealing bed forming a one-piece structural unit, wherein the operating panel has angled side walls in contact with the internal door element, and further comprising liquid discharge chambers, one associated with and for each of the side walls, for discharge of liquid penetrating at the side walls of the operating panel; and appliance component provided on a rear side of the operating panel spaced away from the operating side panel walls to provide protection against liquid penetrating via the liquid discharge chambers, wherein each said liquid discharge chamber is separated by a dividing wall from the appliance components of the operating panel and the dividing wall has a cutout, through which the sealing element is guided into the liquid discharge chamber.

25. The dishwasher of claim 24, wherein angled side walls are vertical.

* * * * *